US005366163A

United States Patent [19]

Daly et al.

[11] Patent Number: 5,366,163

[45] Date of Patent: Nov. 22, 1994

[54] FUEL INJECTOR VALVE HAVING A SPHERE FOR THE VALVE ELEMENT

[75] Inventors: Paul D. Daly, Troy; Robert A. McArthur, Waterford, both of Mich.

[73] Assignee: Siemens Automotive L.P., Auburn Hills, Mich.

[21] Appl. No.: 116,179

[22] Filed: Sep. 2, 1993

[51] Int. Cl.[5] ..... B05B 1/30

[52] U.S. Cl. ..... 239/585.2; 239/585.3

[58] Field of Search ..... 251/129.14, 129.16, 251/129.19; 239/900, 585.3, 585.1

[56] References Cited

U.S. PATENT DOCUMENTS 3,738,578 6/1973 Farrell ..... 239/900 X 3,865,312 2/1975 Lombard et al. ..... 239/900 X 3,884,417 5/1975 Sheffield et al. ..... 239/900 X 4,142,683 3/1979 Casey et al. ..... 239/900 X 5,197,675 3/1993 Daly ..... 251/129.14

*Primary Examiner*—Andres Kashnikow

*Assistant Examiner*—Kevin P. Weldon

*Attorney, Agent, or Firm*—George L. Boller; Russel C. Wells

[57] ABSTRACT

A rolling ball type mechanism is incorporated into a top-feed fuel injector so that the fuel injector has an outward appearance similar to that of known top-feed fuel injectors. The seat member is provided with a slot that makes the flow gradient more uniform over the flow area through the seat member.

7 Claims, 1 Drawing Sheet

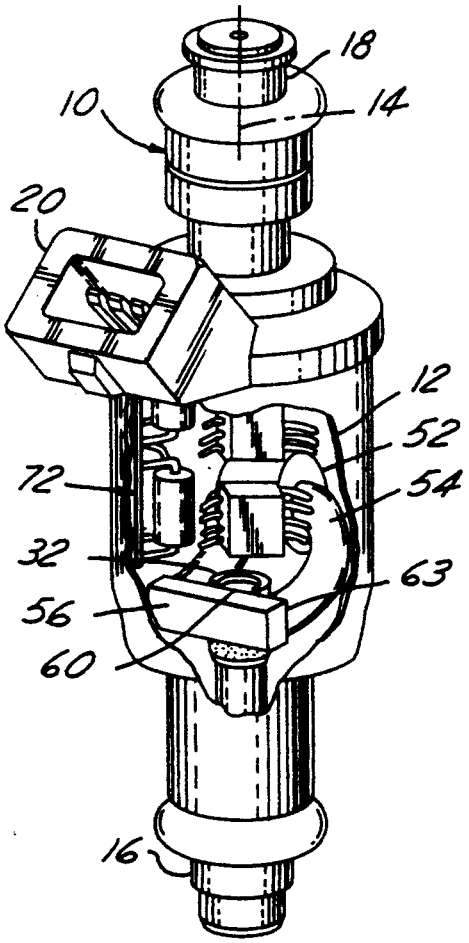
FIG. 1
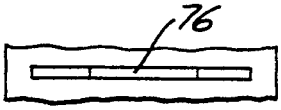
FIG. 5
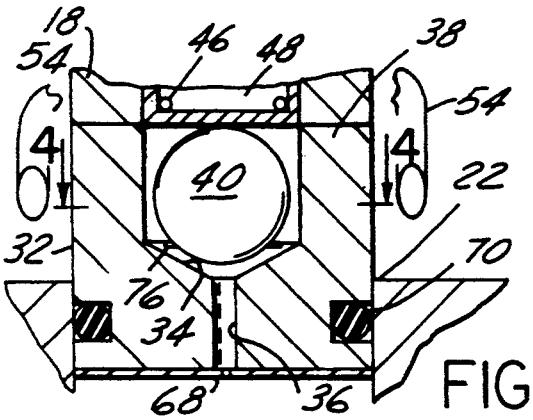
FIG. 3
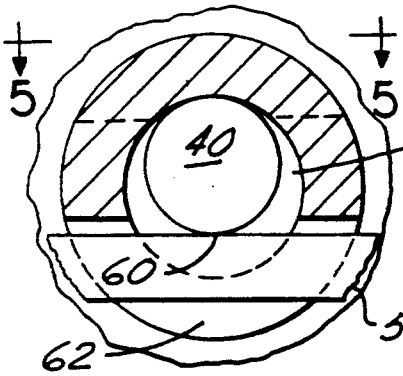
FIG. 4
FIG. 2
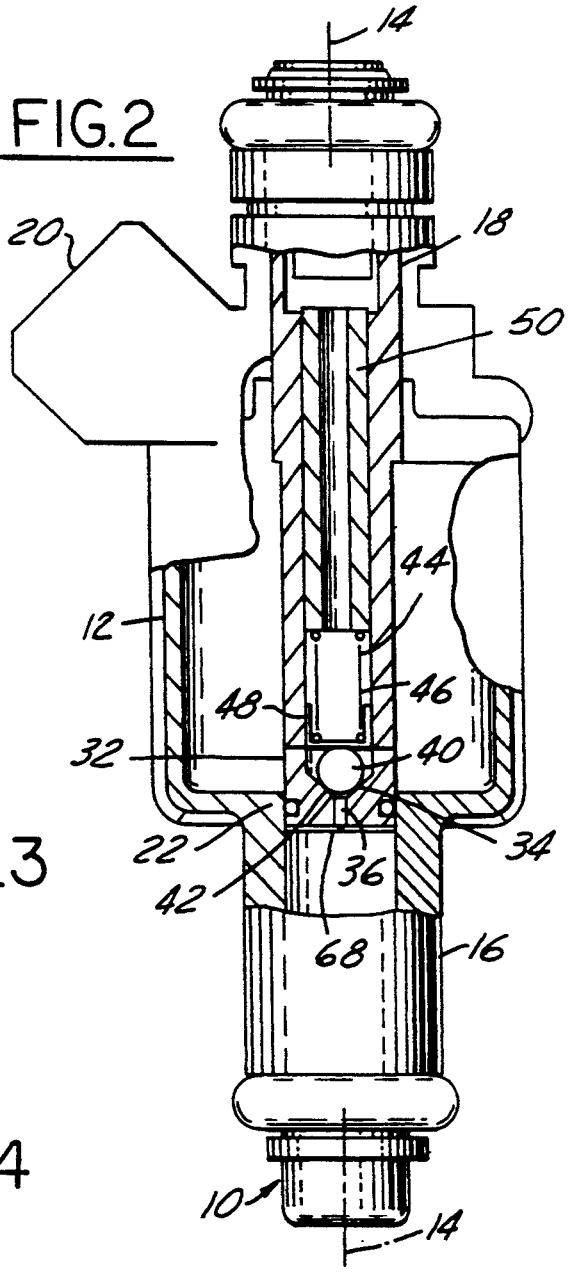

FUEL INJECTOR VALVE HAVING A SPHERE FOR THE VALVE ELEMENT

FIELD OF THE INVENTION

This invention relates to fuel injector valves of the type used to inject fuel into an internal combustion engine other than directly into a combustion chamber of the engine.

BACKGROUND AND SUMMARY OF THE INVENTION

A fundamentally different type of fuel injector valve is disclosed in commonly assigned U.S. Pat. Nos. 5,178,115 and 5,197,675 of Paul D. Daly. The present invention relates to certain improvements in that type of fuel injector valve.

One improvement relates to configuring the actuating mechanism of such a valve in such a way that it can be packaged to look from the exterior much like a prior fuel injector, a top-feed fuel injector for example.

Another improvement relates to a means for reducing variations in the fuel velocity gradient over the area of the fuel flow through the valve seat member when the valve opens.

Further features, advantages, and benefits of the invention will be seen in the ensuing description and claims, which are accompanied by drawings. The drawings disclose a presently preferred embodiment of the invention according to the best mode contemplated at the present time for carrying out the invention.

BRIEF DESCRIPTION OF THE DRAWINGS

FIG. 1 is a perspective view having portions removed for illustrative purposes only, showing the general organization and arrangement of an exemplary fuel injector valve embodying principles of the invention.

FIG. 2 is a side elevational view of FIG. 1, on an enlarged scale and with portions broken away to show a portion in longitudinal cross section.

FIG. 3 is an enlarged fragmentary view of a portion of FIG. 2.

FIG. 4 is a transverse cross sectional view in the direction of arrows 4—4 in FIG. 3.

FIG. 5 is a fragmentary view in the direction of arrows 5—5 in FIG. 4.

DESCRIPTION OF THE PREFERRED EMBODIMENT

FIGS. 1–5 disclose an exemplary fuel injector valve 10 embodying the improvements of the present invention. The fuel injector comprises a generally cylindrical body 12 have an axis 14. At the lower end of body 12, coaxial with axis 14, is a nozzle 16 from which fuel is injected, and at the upper end, also coaxial with axis 14, is a fuel inlet tube 18 through which fuel is introduced. On the exterior of body 12 is an electrical connector 20 that is adapted to be connected via external wiring (not shown) to a remotely located electronic control unit (not shown) for controlling the operation of the fuel injector.

Internally of body 12 is a mounting 22 for a generally cylindrical seat member 32 coaxial with axis 14. Seat member 32 has a frusto-conical surface 34 that funnels to a hole 36 at its smallest diameter. Seat member 32 has a cylindrical sidewall extending from the largest diameter of surface 34. A sphere 40 is bounded by sidewall 38 and in FIG. 1 is shown seated on surface 34, concentric with axis 14 in closure of hole 36. This represents the closed condition of the fuel injector in which sphere 40 is in contact with surface 34 at a circular locus 42 on surface 34. The sphere is resiliently urged to such concentricity by resilient means 44 that is coaxial with axis 14. This resilient means comprises a helical coil spring 46 acting on the sphere through a cap 48 that fits over the lower end of the spring within the interior of tube 18. The upper end of spring 46 bears against the lower end of an adjustment tube 50 that has been inserted a certain distance into tube 18 and fixed relative thereto to produce a desired spring force acting on sphere 40.

The fuel injector has a magnetic circuit within body 12 that is composed of a solenoid coil 52, a stator 54, and an armature 56. Coil 52 is disposed with its axis non-coaxial and non-parallel to axis 14. Stator 54 has a central portion disposed within the interior of coil 52 and portions that extend away from opposite ends of the coil. Since coil 52 is disposed above and to one side of valve seat member 32, the portions of the stator that extend from the opposite ends of the coil extend downwardly and then across the interior of body 12 in generally parallel fashion toward armature 56 such that the valve seat member 32 lies between them.

Armature 56 is in the form of a bar that is disposed along side sphere 40 and operated by the magnetic circuit to act on the sphere at essentially the midpoint of the bar indicated by the reference numeral 60. The sidewall of the seat member contains an opening 62 allowing the armature to act on the sphere. In the condition portrayed in FIGS. 1 and 2, which is for the solenoid coil not energized, the opposite ends of the bar are spaced from ends of the stator by generally equal working gaps 63 and the midpoint of the armature is in contact with the sphere at the end of a particular radial of the sphere. When the solenoid coil is energized, the magnetic flux that is generated in the magnetic circuit operates to reduce the working gaps 63 by attracting armature 56 toward the ends of the stator. This causes armature 56 to be moved bodily predominantly along the direction of an imaginary line that intersects axis 14 and that when viewed along axis 14 is essentially coincident with the radius of the sphere whose end is contacted by the midpoint of the armature. The cooperative effect of the motion of armature 56, of the resilience of resilient means 44, and of the angle of surface 34 is such that the sphere is moved from concentricity with axis 14 to eccentricity with axis 14 with the result that hole 36 opens. Sphere 40 is actually caused to roll slightly up seat 34. This condition is shown in FIG. 3, not necessarily to scale. When energization of the solenoid coil terminates, the magnetic attractive force that stator 54 had been exerting on the armature ceases, and this enables the resiliency of resilient means 44 to return the sphere to concentricity with axis 14 and resultant closure of hole 36.

Hole 36 is covered by a thin disk orifice 68 comprising one or more metering orifices through which fuel is injected into the engine. An O-ring seal 70 is seated in a groove extending around the outside of seat member 32 for sealing to mounting 22. Also with the interior space of body 12 is an electronic circuit assembly 72 that serves to operatively connect solenoid coil 52 with connector 20. When a signal for energizing coil 52 is applied across two of the terminals of connector 20, circuitry of assembly 72 actually applies to the coil a calibrated version of the applied signal, with the calibration factor having been previously programmed into the circuitry via a third terminal of connector 20, as explained in commonly assigned U.S. patent application Ser. No. 07/740,785.

A further feature of seat member 32 is a further opening in the form of a slot 76 that is provided in a semi-circumferential portion of seat member 32 opposite a semi-circumferential portion containing opening 62. Slot 76 has a circumferential dimension that is greater than its axial dimension. It intercepts surface 34 just below the maximum diameter of surface 34. The purpose of slot 76 is to provide a further ingress for fuel to pass through the seat member when sphere 40 is displaced from concentricity with axis 14 so that fuel flow through hole 36 has a more uniform velocity gradient over the flow area. In regard to fuel flow through the fuel injector it should be mentioned that fuel that has entered via inlet tube 18 is not confined to that tube and the interior of seat member 32; rather, provision is made so that fuel can also surround the outside of seat member 32 so as to be available to pass through both openings 62 and 76.

While a presently preferred embodiment of the invention has been illustrated and described, it should be appreciated that principles are applicable to other embodiments.

What is claimed is:

1. In an electromagnetically operated valve which comprises a sphere, a valve body, a valve seat member received in a mounting in said body and comprising a frusto-conical surface of revolution about an axis of said valve seat member having its narrowest diameter leading to an outlet of the valve seat member and a sidewall extending away from the widest diameter of said frusto-conical surface, said sphere being bounded by said sidewall and disposed for coaction with said frusto-conical surface to open and close flow through the valve, resilient means acting to resiliently urge said sphere along said axis toward concentrically seating on said frusto-conical surface at a circular seating locus on said frusto-conical surface and thereby closing flow through the valve by blocking flow to said outlet, and sphere-actuating means, including electromagnetic operating means, for bodily displacing said sphere from concentric seating on said frusto-conical surface comprising a movable bar that is disposed at an opening through said sidewall of said valve seat member along side said sphere and operated by said electromagnetic operating means to execute motion that is predominantly along the direction of an imaginary line that intersects said axis, said bar executing such motion toward and away from said axis in accordance with a control signal applied to said electromagnetic operating means, such motion of said bar toward said axis creating a force acting on said sphere at the end of a radial of said sphere, which radial, when viewed along said axis, is substantially coincident with said imaginary line, and such force created by such motion of said bar along said imaginary line being effective, in cooperation with said frusto-conical surface and said resilient means, to cause said sphere to be bodily displaced from concentricity with said axis to eccentricity with said axis thereby opening flow through the valve by unblocking flow to said outlet, and such motion of said bar away from said axis being effective to allow said resilient means, in cooperation with said frusto-conical surface, to cause said sphere to be restored to concentricity with said axis and thereby close flow through the valve by blocking flow to said outlet, the improvement which comprises a further opening through said sidewall of said valve seat member that is disposed beyond said circular seating locus relative to said outlet in a semi-circumference of said valve seat member that is opposite a semi-circumference of said valve seat member containing the first-mentioned opening.

2. The improvement set forth in claim 1 in which said further opening intercepts said frusto-conical surface.

3. The improvement set forth in claim 2 in which said further opening is an arcuate slot having a circumferential extent about said axis that is greater than its axial extent along said axis.

4. A fuel injector valve comprising a cylindrical body having an axis, a nozzle at one axial end of said body from which fuel is injected, a fuel inlet to said body at which fuel is introduced, an electrical connector on the exterior of said body, a valve seat member disposed within said body and comprising a frusto-conical surface of revolution disposed coaxial with said axis of said body, the narrowest diameter of said frusto-conical surface leading to an outlet of the valve seat member that itself leads to said nozzle, the widest diameter of said frusto-conical surface leading to a sidewall of said valve seat member extending from said frusto-conical surface, said sphere being bounded by said sidewall and disposed for coaction with said frusto-conical surface to open and close flow through the valve, resilient means disposed coaxial with said axis of said body acting a resiliently urge said sphere along said axis toward concentrically seating on said frusto-conical surface at a circular seating locus on said frusto-conical surface and thereby closing flow through the valve by blocking flow to said outlet, and sphere-actuating means, including electromagnetic operating means comprising a solenoid coil electrically connected with said electrical connector but disposed with its own axis non-coaxial and non-parallel to said axis of said cylindrical body, for bodily displacing said sphere from concentric seating on said frusto-conical surface comprising a movable bar that is disposed at an opening through said sidewall of said valve seat member along side said sphere and operated by said electromagnetic operating means to execute motion that is predominantly along the direction of an imaginary line that intersects said axis of said body, said bar executing such motion toward and away from said axis of said body in accordance with a control signal applied to said solenoid coil via said electrical connector, such motion of said bar toward said axis of said body creating a force acting on said sphere at the radially outer end of an imaginary radial to said sphere, which imaginary radial, when viewed along said axis of said body, is substantially coincident with said imaginary line, and such force created by such motion of said bar along said imaginary line being effective, in cooperation with said frusto-conical surface and said resilient means, to cause said sphere to be bodily displaced from concentricity with said axis of said body to eccentricity with said axis of said body thereby opening flow through the valve by unblocking flow to said outlet, and such motion of said bar away from said axis of said body being effective to allow said resilient means, in cooperation with said frusto-conical surface, to cause said sphere to be restored to concentricity with said axis of said body and thereby close flow through the valve by blocking flow to said outlet, and a further opening through said sidewall of said valve seat member that is disposed beyond said circular seating locus relative to said outlet in a semi-circumference of said valve seat member that is opposite a semi-circumference of said valve seat member containing the first-mentioned opening.

5. A fuel injector valve comprising a cylindrical body having an axis, a nozzle at one axial end of said body from which fuel is injected, a fuel inlet to said body at which fuel is introduced, an electrical connector on the exterior of said body, a valve seat member disposed within said body and comprising a frusto-conical surface of revolution disposed coaxial with said axis of said body, the narrowest diameter of said frusto-conical surface leading to an outlet of the valve seat member that itself leads to said nozzle, the widest diameter of said frusto-conical surface leading to a sidewall of said valve seat member extending from said frusto-conical surface, said sphere being bounded by said sidewall and disposed for coaction with said fursto-conical surface to open and close flow through the valve, resilient means disposed coaxial with said axis of said body acting to resiliently urge said sphere along said axis toward concentrically seating on said frusto-conical surface at a circular seating locus on said frusto-conical surface and thereby closing flow through the valve by blocking flow to said outlet, and sphere-actuating means, including electromagnetic operating means comprising a solenoid coil electrically connected with said electrical connector but disposed with its own axis non-coaxial and non-parallel to said axis of said cylindrical body, for bodily displacing said sphere from concentric seating on said frusto-conical surface comprising a movable bar that is disposed at an opening through said sidewall of said valve seat member along side said sphere and operated by said electromagnetic operating means to execute motion that is predominantly along the direction of an imaginary line that intersects said axis of said body, said bar executing such motion toward and away from said axis of said body in accordance with a control signal applied to said solenoid coil via said electrical connector, such motion of said bar toward said axis of said body creating a force acting on said sphere at the radially outer end of an imaginary radial to said sphere, which imaginary radial, when viewed along said axis of said body, is substantially coincident with said imaginary line, and such force created by such motion of said bar along said imaginary line being effective, in cooperation with said frusto-conical surface and said resilient means, to cause said sphere to be bodily displaced from concentricity with said axis of said body to eccentricity with said axis of said body thereby opening flow through the valve by unblocking flow to said outlet, and such motion of said bar away from said axis of said body being effective to allow said resilient means, in cooperation with said frusto-conical surface, to cause said sphere to be restored to concentricity with said axis of said body and thereby close flow through the valve by blocking flow to said outlet, and electronic circuitry within said body operatively connected between said solenoid coil and said electrical connector.

6. A fuel injector valve comprising a cylindrical body having an axis, a nozzle at one axial end of said body from which fuel is injected, a fuel inlet to said body at which fuel is introduced, an electrical connector on the exterior of said body, a valve seat member disposed within said body and comprising a frusto-conical surface of revolution disposed coaxial with said axis of said body, the narrowest diameter of said frusto-conical surface leading to an outlet of valve seat member that itself leads to said nozzle, the widest diameter of said frusto-conical surface leading to a sidewall of said valve seat member extending from said frusto-conical surface, said sphere being bounded by said sidewall and disposed for coaction with said frusto-conical surface to open and close flow through the valve, resilient means disposed coaxial with said axis of said body acting to resiliently urge said sphere along said axis toward concentrically seating on said frusto-conical surface at a circular seating locus on said frusto-conical surface and thereby closing flow through the valve by blocking flow to said outlet, and sphere-actuating means, including electromagnetic operating means comprising a solenoid coil electrically connected with said electrical connector but disposed with its own axis non-coaxial and non-parallel to said axis of said cylindrical body, for bodily displacing said sphere from concentric seating on said frusto-conical surface comprising a movable bar that is disposed at an opening through said sidewall of said valve seat member along side said sphere and operated by said electromagnetic operating means to execute motion that is predominantly along the direction of an imaginary line that intersects said axis of said body, said bar executing such motion toward and away from said axis of said body in accordance with a control signal applied to said solenoid coil via said electrical connector, such motion of said bar toward said axis of said body creating a force acting on said sphere at the radially outer end of an imaginary radial to said sphere, which imaginary radial, when viewed along said axis of said body, is substantially coincident with said imaginary line, and such force created by such motion of said bar along said imaginary line being effective, in cooperation with said frusto-conical surface and said resilient means, to cause said sphere to be bodily displaced from concentricity with said axis of said body to eccentricity with said axis of said body thereby opening flow through the valve by unblocking flow to said outlet, and such motion of said bar away from said axis of said body effective to allow said resilient means, in cooperation with said frusto-conical surface, to cause said sphere to be restored to concentricity with said axis of said body and thereby close flow through the valve by blocking flow to said outlet, and in which said fuel inlet comprises a fuel inlet tube that is coaxial with said axis of said body and enters said body from an axial end thereof opposite said nozzle, an adjustment tube is disposed within said fuel inlet tube, said resilient means comprises a helical coil spring disposed between said adjustment tube and said sphere.

7. A fuel injector valve as set forth in claim 6 comprising a cap covering one end of said spring and disposed between said spring and said sphere.

* * * * *